United States Patent [19]

Abell

[11] 4,129,915

[45] Dec. 19, 1978

[54] CABLE TENSIONING MEANS FOR KING POST STRUCTURING

[75] Inventor: William R. Abell, Fairfax, Va.

[73] Assignee: The United States of America as represented by the Secretary of the Army, Washington, D.C.

[21] Appl. No.: 896,528

[22] Filed: Apr. 14, 1978

[51] Int. Cl.[2] ..... E01D 9/02

[52] U.S. Cl. ..... 14/10; 14/17; 52/225

[58] Field of Search ..... 14/10, 9, 17; 52/225

[56] References Cited

U.S. PATENT DOCUMENTS

| | | | |
|---|---|---|---|
| 29,825 | 8/1860 | Roebling | 14/17 |
| 238,130 | 2/1881 | Lawrence | 14/11 |
| 455,687 | 7/1891 | McCarthy | 52/225 |
| 460,213 | 9/1891 | McCarthy | 52/225 |
| 3,091,897 | 6/1963 | Hillberg | 52/225 |
| 3,427,773 | 2/1969 | Kandall | 52/225 |
| 4,021,875 | 5/1977 | Abell | 14/10 |

FOREIGN PATENT DOCUMENTS

| | | | |
|---|---|---|---|
| 2324646 | 12/1974 | Fed. Rep. of Germany | 14/10 |

*Primary Examiner*—Nile C. Byers, Jr.
*Attorney, Agent, or Firm*—Nathan Edelberg

[57] ABSTRACT

A cable tensioning means for use in reinforcing bridges or structural spans. The unit is stowed for transport within the confines of the structure and is moved into operating position by a hydraulic leverage system. The reinforcing cable is fixed at each end and is threaded around dual sheaves within the unit. Tension or prestress is introduced to the cable by separation of causing one sheave to move away from the other.

2 Claims, 3 Drawing Figures

CABLE TENSIONING MEANS FOR KING POST STRUCTURING

DEDICATORY CLAUSE

The invention described herein may be manufactured, used and licensed by or for the Government for governmental purposes without the payment to me of any royalties thereon.

BACKGROUND OF THE INVENTION

This invention relates to the field of bridges provided with tensioned cables to reinforce the structure. When working with several of the known cable reinforced bridge structure, the attachment and tensioning of the cable reinforcement and the erection of the necessary king and queen posts that transmit the tensile forces in the cable to the bridge structure, take considerable time and can present construction difficulties. Such problems can become serious when dealing with temporary bridges like those used in the military field where such arrangements are commonly employed and where time is often at a premium.

SUMMARY OF THE INVENTION

The present invention provides a solution to the above stated problems by using a king or queen post pivoted to the bridge structure at a location between the spaced cable end points. A cable tensioning means is supported by the king or queen posts and the cable is threaded around two sheaves in the tensioning means. When actuated a hydraulic motor operates a gear box to cause one sheave to move away from the other sheave thereby introducing tension to the cable for reinforcing the bridge structure.

This invention may be better understood from the following detailed description taken in conjunction with the accompanying drawing.

DESCRIPTION OF THE PREFERRED EMBODIMENT

Figure 1:
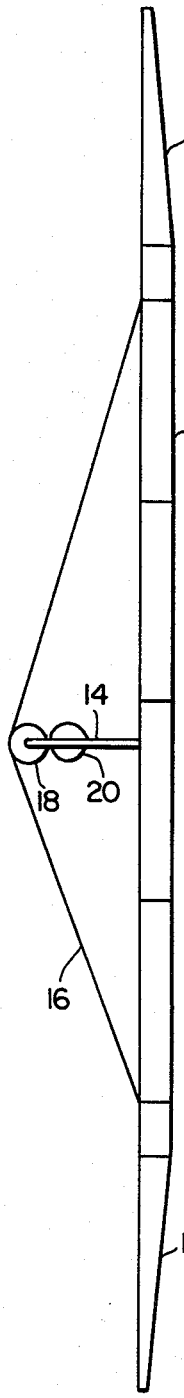
FIG. 1 is diagrammatic representation of a bridge arrangement.
Figure 2:
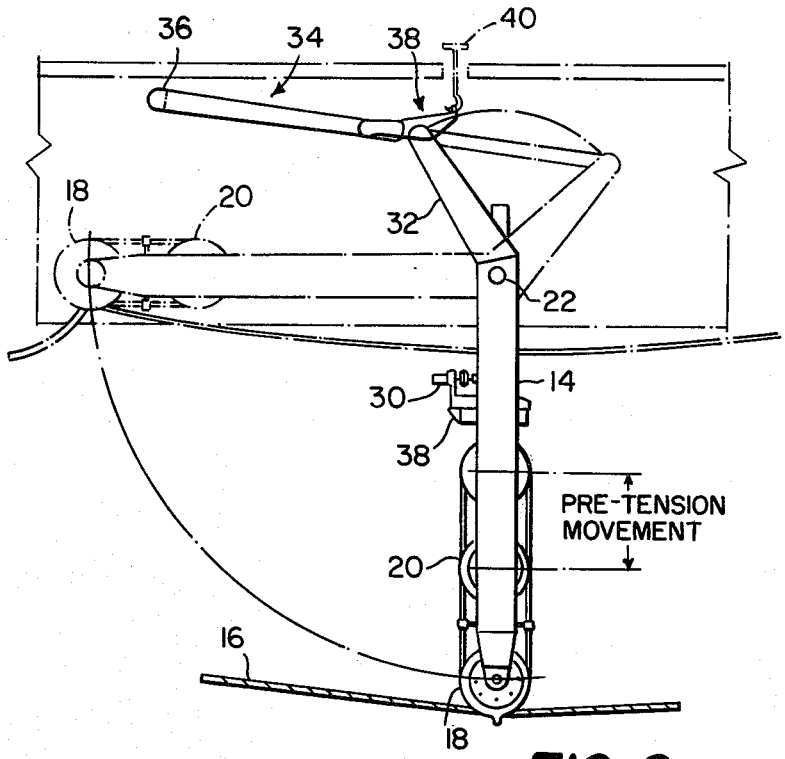
FIG. 2 is a detail showing the construction of a king post.

Referring now to the drawing reference numeral 10 indicates a bridge span having attached end ramps 12 and a king post 14 shown erected centrally of the span. A reinforcing cable 16 is shown extending from one end of the span to the other end and is threaded around dual sheaves 18, 20, more clearly shown in FIGS. 2 and 3. The king post 14 as shown in FIG. 2 is rotatably attached to the bridge span 10 by a pivot 22. Thus, the post can swing from a stowed position, shown in dotted outline, to an erected position in which it extends downwardly below the span 10. The post 14 carries at its end sheave 18 that is provided with two grooves and is supported on the shaft 22. The second sheave 20 is supported by a movable shaft support 24. Cable 16 is threaded around part of one of the grooves in sheave 18, over sheave 20 and back through the second groove of sheave 18.

Figure 3:
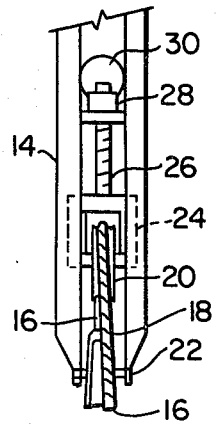
FIG. 3 is a view showing details of the dual sheaves.

As more clearly seen in FIG. 3, a worm gear 26 is attached at one end to the movable shaft support 24 and its other end is connected to a gear box 28 that in turn is driven by a hydraulic motor 30 which causes shaft support 24 to raise or lower sheave 20 for tensioning purposes.

The king post 14 has attached thereto or integral therewith a shorter arm 32 extending from the pivot on the side thereof remote from the main post 14. The outer end of arm 32 is connected to the ram of a hydraulic jack 34 which is mounted on the bridge span 10 by a pivot 36. As seen in FIG. 2, extension of the jack 34 raises the post 14 and cable 16 into a stowed position (showed dotted) where the post lies within the boundries of the span 10 with the cable extending loosely along the lower surface of the span. Retraction of the jack automatically erects the king post 14 to its operative position. Operation of the motor 30 will cause sheave 20 to move away from the stationary sheave 18 thereby providing tension in cable 16. This sheave arrangement provides a wide tolerance in cable length and readily provides a change in prestress when the structure is in operation. Thus, differing length spans can readily be accomplished by varying the cable length without the necessity of retaining a close cable tolerance. A spring loaded locking switch 38 may be incorporated to lock the king post 14 in its erect position and, thus, relieve the stress on jack 34. The catch is released by the use of a lifting hook 40.

I claim:

1. A bridge structure having at least one tensioning cable attached thereto at two longitudenally spaced points, at least one post pivoted to said bridge structure at a location between said spaced points, an end of said post spaced from the pivot connection to said bridge structure adapted to engage the cable; means associated with and attached to said bridge structure and said post for rotating said post about the pivot connection to said bridge structure into its operative position, said operative position being substantially perpendicular to the span of said bridge structure; sheave means associated with and attached to said post; said tensioning cable being threaded around said sheaves and means associated with said sheaves for causing separation of said sheaves whereby tension is introduced to said cable for reinforcing the bridge structure.

2. A bridge structure as set forth in claim 1 wherein said means for causing separation of the sheaves includes a worm gear connected to one of said sheaves, a gear box connected to said worm gear and a hydraulic motor for operating said gear box.

* * * * *